US005343005A

United States Patent [19]

Salzmann

[11] Patent Number: 5,343,005

[45] Date of Patent: Aug. 30, 1994

[54] HYDRAULIC MASTER CYLINDER SWITCH

[75] Inventor: David F. Salzmann, South Lyon, Mich.

[73] Assignee: Automotive Products plc, Warwickshire, England

[21] Appl. No.: 42,353

[22] Filed: Apr. 2, 1993

[51] Int. Cl.[5] ..... H01H 3/14

[52] U.S. Cl. ..... 200/61.89

[58] Field of Search ..... 200/61.89, 16 R–16 F, 200/1 B

[56] References Cited

U.S. PATENT DOCUMENTS

| | | | |
|---|---|---|---|
| 2,006,690 | 7/1935 | Blake | 200/61.89 X |
| 2,222,765 | 11/1940 | Geyer | 200/61.89 X |
| 3,487,183 | 12/1969 | Schulman | 200/61.89 |
| 4,742,193 | 5/1988 | Kassin et al. | 200/61.89 |

*Primary Examiner*—J. R. Scott
*Attorney, Agent, or Firm*—Krass & Young

[57] ABSTRACT

A switch mounted on the push rod of a master cylinder assembly and controlling in sequence several switches such, for example, as a cruise control switch, an electronic fuel injection switch, and a start interlock switch. The switch includes a hollow housing defining a central chamber through which the push rod passes and a plunger assembly carried by the push rod and mounted for axial movement within the chamber. The plunger assembly includes a primary plunger and a secondary plunger carried by and movable axially relative to the primary plunger. The initial portion of the forward movement of the push rod allows incremental forward movement of the secondary plunger to actuate a first series of switches whereafter the push rod moves further forwardly without either plunger whereafter the push rod engages the primary plunger to move the plunger assembly forwardly to actuate a further switch. The lost or relative movement between the push rod and the plunger assembly allows the switch housing to be significantly shortened and thereby allows the switch to be utilized on relatively short push rods.

20 Claims, 6 Drawing Sheets

HYDRAULIC MASTER CYLINDER SWITCH

BACKGROUND OF THE INVENTION

This invention relates to an electrical switch operated by the input member of a hydraulic master cylinder assembly, such as the master cylinder of a motor vehicle clutch hydraulic control system or the master cylinder of a motor vehicle hydraulic brake system.

It has become general practice in the automobile industry to interlock the operation of the engine starter motor with other controls of the motor vehicle such that the starter member is rendered inoperative unless the transmission is in neutral or park in motor vehicles provided with an automatic transmission or, in motor vehicles provided with a foot operated clutch and a manually operated gear shift transmission, unless the transmission is in neutral and/or the clutch pedal is fully depressed, to fully release the clutch. In addition, it is convenient in a motor vehicle provided with a cruise control and a mechanical clutch to shut off the operation of the cruise control upon, for example, downshifting which in turn requires release of the clutch. However, it is necessary that the cruise control be disconnected even before the clutch is fully released to enable the driver to cut ore the cruise control by a slight foot tap on the clutch pedal. It is also desirable to actuate the electronic fuel control (EFI) of the motor vehicle in response to the initial depressing movement of the clutch.

Many switch arrangements have been provided for use in association with the master cylinder assembly to accomplish the various desired switching operations as the clutch pedal is depressed. Examples of such switches are shown, for example, in U.S. Pat. Nos. 4,878,041, 4,719,444, 474219 and 4,649,238. The switch devices shown in these prior art patents are all of the type in which the switch mounts on the push rod of the master cylinder assembly and in which the switch includes a plurality of axially spaced switches which can be sequentially actuated in response to depression of the clutch to generate a sequential series of control signals with respect to cruise control, EFI interlock, etc. Whereas these prior art switches have proven to be generally satisfactory, generating the required control signals in response to depression of the clutch, the sequential arrangement of the various switches along the length of the switch results in a relatively long switch assembly which is incompatible with the relatively short push rods that are found in many present day motor vehicles.

SUMMARY OF THE INVENTION

This invention is directed to the provision of an improved master cylinder switch.

More specifically, this invention is directed to the provision of a master cylinder switch that fits over the push rod of the master cylinder and that is compact enough to use even with very short push rods.

The invention relates to a hydraulic master cylinder assembly of the type including a master cylinder, a piston mounted in the master cylinder, a push rod projecting at its forward end into the rear end of the master cylinder for connection to the piston, and a switch assembly positioned on the push rod and including a hollow switch housing defining axially spaced first and second switch means and a plunger assembly mounted for sliding movement in the housing in response to forward movement of the push rod to Sequentially coact with the housing switch means to actuate the switch means to generate sequential first and second control signals.

According to the invention, in the initial increment of forward movement of the push rod, the plunger assembly acts to actuate the first switch means, in the second increment of forward movement of the push rod the push rod moves forwardly relative to the plunger assembly, and in the third increment of forward movement of the push rod the plunger assembly moves forwardly with the push rod to actuate the second switch means. This arrangement allows the push rod to move relative to the plunger assembly between the actuation of the first and second switch means so as to reduce the overall length of the switch housing and allow the switch to be used on even very short push rods.

According to a further feature of the invention, the plunger assembly includes a first plunger member and a second plunger member mounted on the first plunger member and axially movable relative to the first plunger member and the actuation of the first switch means upon the initial increment of forward movement of the push rod comprises movement of the second plunger member with the push rod and relative to the first plunger member. The provision of a two-part plunger assembly allows the switch actuating functions of the plunger assembly to be separated to further facilitate the provision of an extremely short switch assembly.

According to a further feature of the invention, the first switch means is spring biased to a first position and movable against the resistance of the spring to a second position; with the push rod in the fully rearwardly extending position the second plunger member maintains the first switch means in its second position; and as the push rod undergoes its initial increment of forward movement it releases the second plunger member and allows it to move forwardly with the push rod to allow the first switch means to move to its first position under the bias of the switch means. This arrangement allows the built-in bias of the switch means to perform the initial switching function.

According to a further feature of the invention, the push rod defines first and second axially spaced radially extending actuating surfaces; with the push rod in its fully rearwardly extending position, the first actuating surface precludes forward movement of the second plunger member so as to maintain the first switch means in its second position; and the second actuating surface engages the plunger assembly as the push rod begins its third increment of forward movement. This specific arrangement facilitates the provision of lost motion as between the push rod and the plunger assembly.

According to a further feature of the invention, the first actuating surface coacts with a forwardly facing surface on the second plunger member; the second actuating surface coacts with a rearwardly facing surface on the first plunger member; and the actuating surfaces are spaced axially by a distance greater than the distance between the forwardly and rearwardly facing surfaces on the plunger assembly so that the push rod undergoes forward movement relative to the plunger assembly following the movement of the first switch means to its first position and prior to engagement of the plunger assembly by the second actuating surface.

According to a further feature of the invention, the first and second actuating surfaces comprise first and second annular shoulder surfaces on the push rod. In the disclosed embodiment of the invention, one of the annular shoulders comprises a shoulder formed at the juncture of a large diameter portion of the push rod with a reduced diameter portion of the push rod portion and the other annular shoulder is defined by a ring fixedly secured to the reduced diameter portion of the push rod.

In the disclosed embodiment of the invention, the hollow switch housing includes a rear end wall and an annular interior surface extending forwardly from the rear end wall and in surrounding relation to the central axis of the push rod; the first switch means is provided on the housing rear end wall; the second switch means is provided on the housing interior annular surface; and the plunger assembly includes a first plunger member mounted for sliding movement on the housing annular surface for coaction with the second switch means on the annular surface and a second plunger member carried by, and movable axially relative to, the first plunger member for coaction with the first switch means on the rear end wall of the housing.

DETAILED DESCRIPTION OF THE PREFERRED EMBODIMENT

Figure 1:
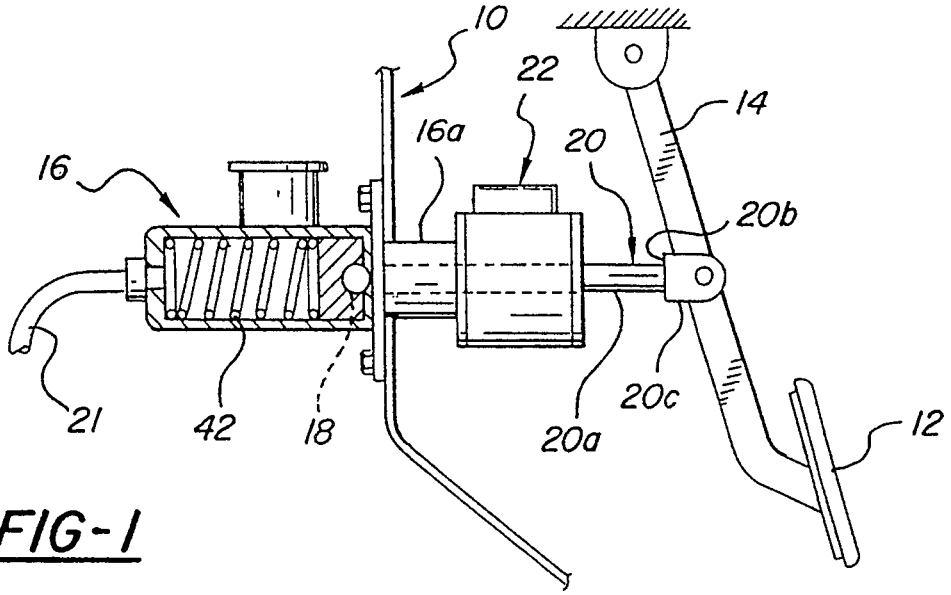
FIG. 1 is a fragmentary somewhat schematic view of a master cylinder assembly including a master cylinder switch according to the invention.
Figure 2:
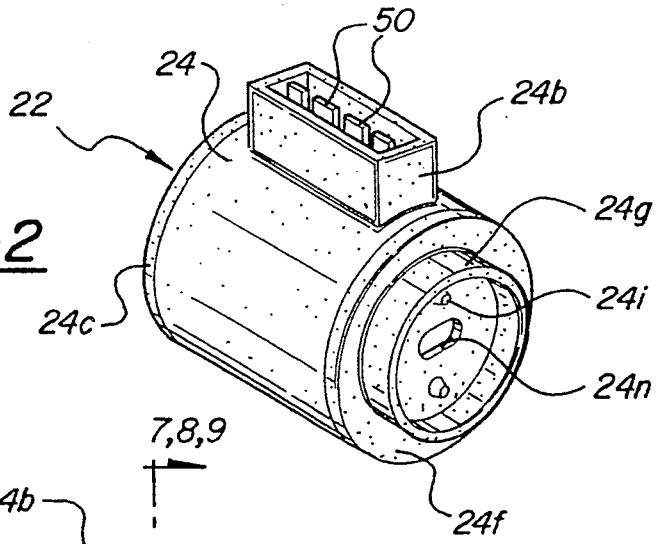
FIG. 2 is a perspective view of the master cylinder switch.

The invention master cylinder switch assembly is seen in FIG. 1 in association with a motor vehicle of the type including a fire wall 10, a control pedal 12 (such as a clutch pedal or a brake pedal) positioned on the lower end of a pivotally mounted pedal arm 14; a master cylinder 16 secured in known manner to the front face of the fire wall 10 and projecting at its forward portion 16*a* through and forwardly of the fire wall; a piston 18 mounted for reciprocal movement in the cylinder 16; and a push rod 20 pivotally secured at its rear end to control arm 14 and pivotally associated at its forward end with piston 18 so that, in known manner, as pedal 12 is depressed, push rod 20 moves forwardly into the rear end of the master cylinder to move the piston 18 forwardly within the cylinder and transmit pressurized hydraulic fluid through conduit 21 for use by a suitable slave cylinder to actuate, for example, a clutch or brake of the motor vehicle). The invention switch assembly 22 is mounted on the push rod 20 rearwardly of the master cylinder and within the passenger compartment.

Switch assembly 22 includes a housing 24, a plunger assembly 25, springs 26, a cruise control switch 27, an EFI switch 28, and interlock switch contact strips 29.

Housing 24 is formed of a suitable plastics material and includes an annular central main body member 24*a* including an upstanding contact housing portion 24*b*; a rear end wall member 24*c* fixedly secured to the rear end of annular main body member 24*a*, defining a central aperture 24*d* for passage of the push rod 20*j*, and further defining a pair of parallel forwardly extending guide rod portions 24*e* disposed on opposite sides of the central axis 30 of the push rod; and a front end wall member 24*f* fixedly secured to the front annular edge of the annular central main body member 24*a* and including a hub portion 24*g* and apertures 24*h* sized to receive the forward ends 24*i* of the guide rod portions 24*e* of rear end wall member 24*c*. Annular main body portion 24*a* defines a cylindrical interior axially extending surface 24*j*, a pair of parallel upper axially extending ridge portions 24*k*, and a pair of parallel lower axially extending ridge portions 24*m*.

Plunger assembly 25 includes a primary plunger member 32 and a secondary plunger member 34 both formed of a suitable plastics material.

Figure 3:
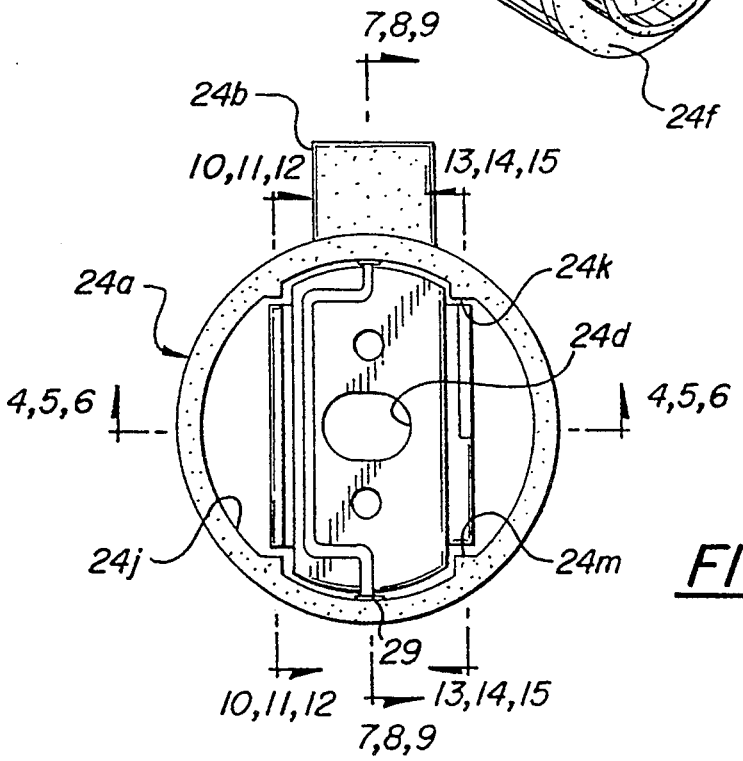
FIG. 3 is a cross-sectional view of the master cylinder switch.

Primary plunger member 32 has a generally U configuration in cross section and includes upper and lower leg portions 32*a* and a central web portion 32*b*. As best seen in FIG. 3, plunger member 32 is sized to slide within the annular main body portion 24*a* of the housing with the arcuate upper and lower surfaces 32*c* of the legs 32*a* conforming to the annular housing surface 24*j* and with the upper and lower ends of the plunger member guiding on ridges 24*k* and 24*m* to maintain the plunger member in a generally upright configuration as seen in FIG. 3. Web portion 32*b* includes a central aperture 32*d* to pass the push rod 20 and upper and lower hub portions 32*e*. A transversely extending ridge 34*f* is provided on the inboard face of each leg portion 32*a* in forwardly spaced relation to web portion 32*b*.

Secondary plunger member 34 also has a generally U configuration in cross section and includes a partial side flange portion 34*a*, a full side flange portion 34*b*, and a central web portion 34*c*. Web portion 34*c* includes apertures 34*d* to pass the hub portions 32*e* of primary plunger member 32 and a central aperture 34*e* to pass the push rod 20. In the assembled relation of primary plunger member 32 and secondary plunger member 34, the secondary plunger member is interlinked with and carried by the primary plunger member with central aperture 34*e* aligned with central aperture 32*d*, apertures 34*d* receiving hub portions 32*e* of the primary plunger member, web portions 34*c*, 32*b* in confronting relation, and flanges 34*a* and 34*b* extending rearwardly and arms 32*a* extending forwardly.

Springs 26 comprise coil springs and are sized to be fitted around guide rod portions 24*e*.

Figure 4:
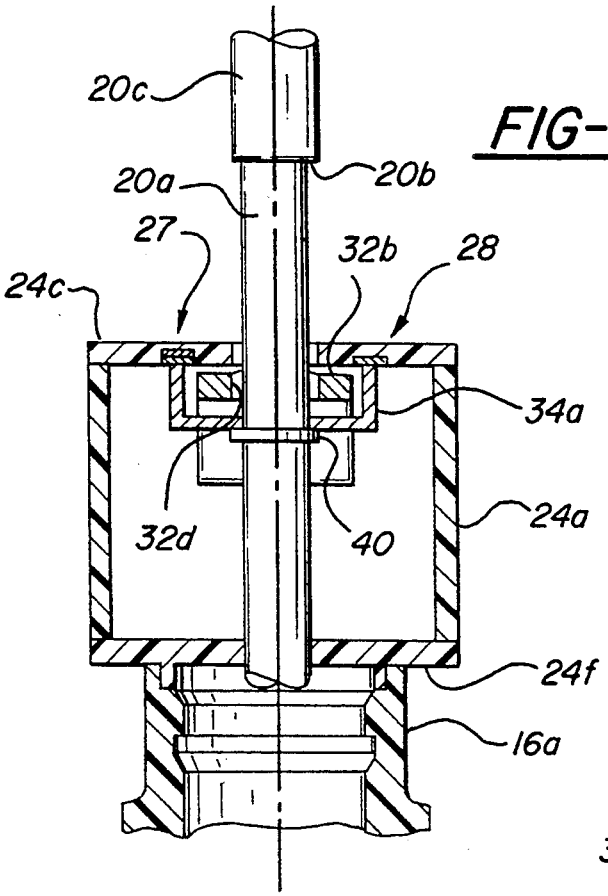
FIGS. 4–15 are cross-sectional views taken where indicated on FIG. 3.
Figure 10:
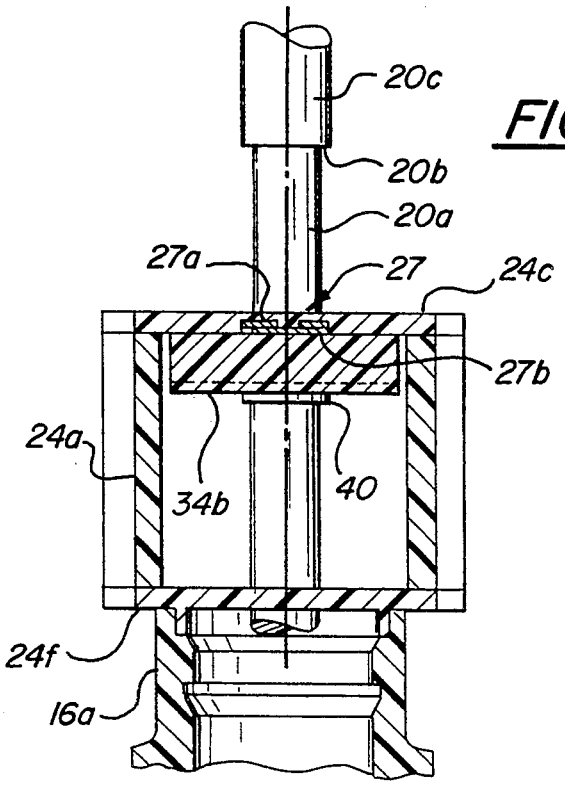
Figure 11:
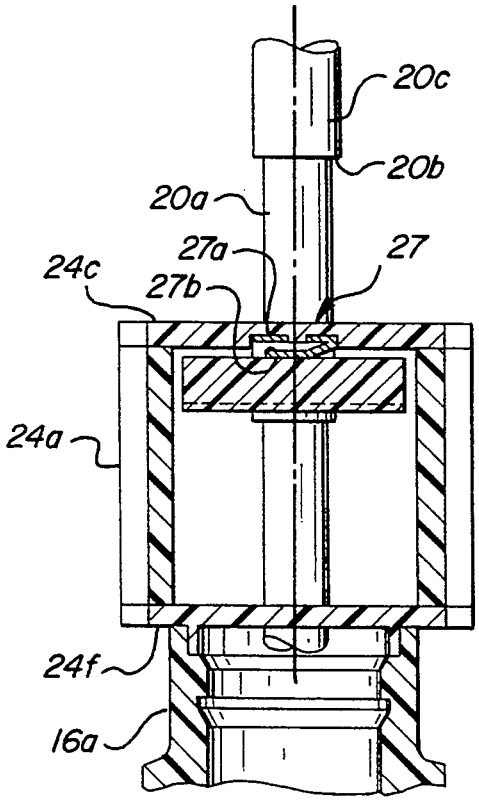
Figure 12:
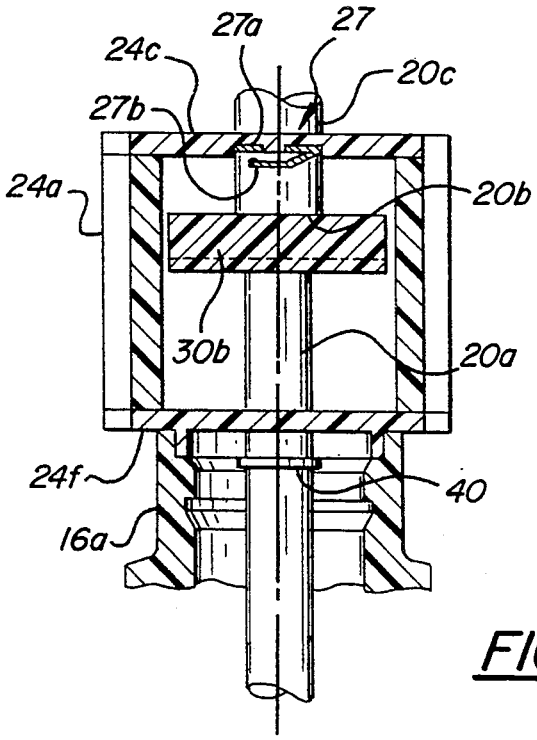

Cruise control switch 27 includes a fixed contact 27*a* mounted on the inboard face 24*n* of housing rear end wall member 24*c* on one side of central axis 30 and a cantilever blade contact 27*b* mounted on inboard face 24*n* proximate fixed contact 27*a*. Cruise control switch 27 is normally spring biased to the open position seen in FIGS. 5, 6, 11, and 12 in which cantilever blade contact 27*b* is spaced from fixed blade contact 27*a* but is movable against the resistance of the spring bias to the closed position seen in FIGS. 4 and 10.

Figure 13:
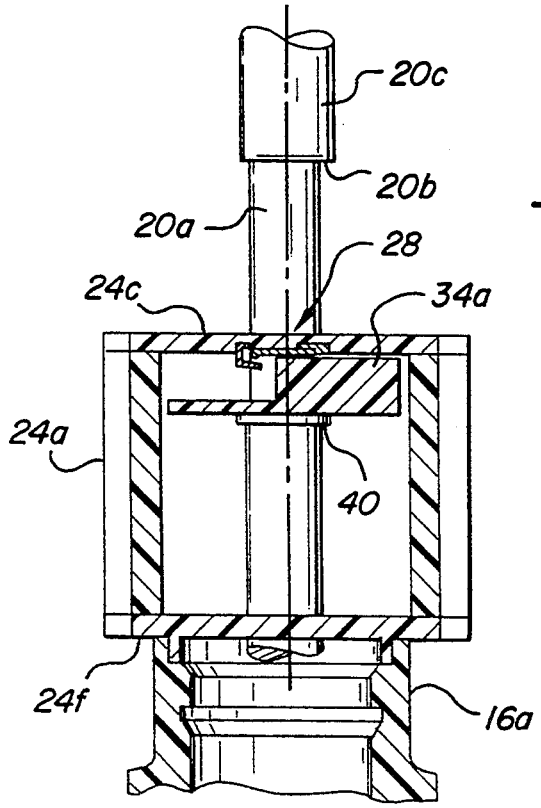

EFI switch 28 includes a fixed contact 28*a* mounted on inboard housing face 24*n* in diametrically opposed relation to fixed contact 27*a* and a cantilever blade contact 28*b* mounted on inboard face 24*n* proximate fixed contact 28*a*. EFI switch 28 is spring biased to the closed position seen in FIGS. 5, 6, 14, and 15 in which cantilever blade contact 28*b* contacts fixed contact 28*a* but is movable against the resistance of the spring bias to the open position seen in FIGS. 4 and 13.

Interlock switch contact strips 29 are mounted in axially extending disposition at diametrically opposed locations on housing interior cylindrical surface 24*j* proximate the front end of the housing.

In the assembled relation of the switch assembly and the master cylinder assembly, the switch is positioned in surrounding relation to push rod 20 rearwardly of the master cylinder. Specifically, housing hub portion 24*g* is received within the bore 16*b* defined at the rear end of the master cylinder rear end portion 16*a*; push rod 20 includes reduced diameter portion 20*a* passing through central aperture 24*d* in housing rear end wall member 24, aperture 32*d* in primary plunger member 32, aperture 34*e* in secondary plunger member 34, and aperture 24*p* in the housing front end wall member 24*f* for passage into the rear end of the hydraulic master cylinder for pivotal connection with piston 18; primary plunger member 32 is positioned within the hollow of the housing with hub portions 32*e* encircling guide rods 24*e*; springs 26 are positioned around guide portions 24*e* with their .forward ends bearing against the front wall of the housing and their rear ends received within hub portions 32*e* so as to bias the plunger member 32 toward the rear end of the housing; secondary plunger member 34 is mounted on and carried by primary plunger member 32; a ring 40 fixedly positioned on push rod reduced diameter portion 20*a* coacts with an annular forwardly facing surface 34*f* on the front face of the web portion of secondary plunger member 34; and an annular shoulder 20*b* formed at the juncture of reduced diameter push rod portion 20*a* and main body push rod portion 20*c* is arranged for pushing coaction with an annular rearwardly facing surface 32*g* on the primary plunger member 32 in surrounding relation to central aperture 32*d*.

It will be understood that a return spring 42 in cylinder 16 acts against piston 18 and normally maintains the push rod 20 in a fully rearwardly extended position (seen in FIG. 1) as determined by the engagement of the piston with a suitable stop member proximate the rear end of the master cylinder. With the push rod in its fully rearwardly extended position, and as seen in FIGS. 4, 7, 10 and 13, ring 40 bears against surface 34*f* on secondary plunger member 34 to press flange 34*b* rearwardly against the cantilever blade contact 27*b* of cruise control switch 27 and press flange 34*a* against the cantilever blade , contact 28*b* of EFI switch 28. Flange 34*b* has the effect of maintaining cruise control switch 27 in a closed position against the spring bias of the switch and flange 34*a* has the effect of maintaining EFI switch 28 in an open position against the spring bias of the switch.

Figure 5:
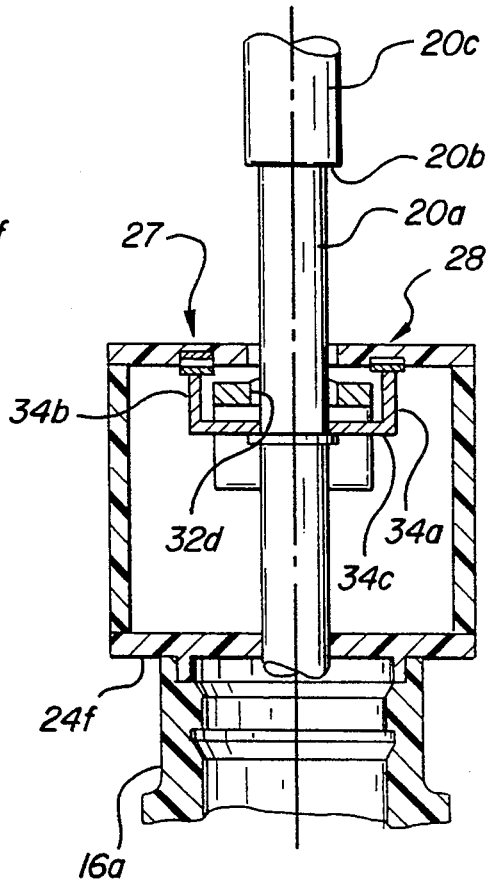
Figure 6:
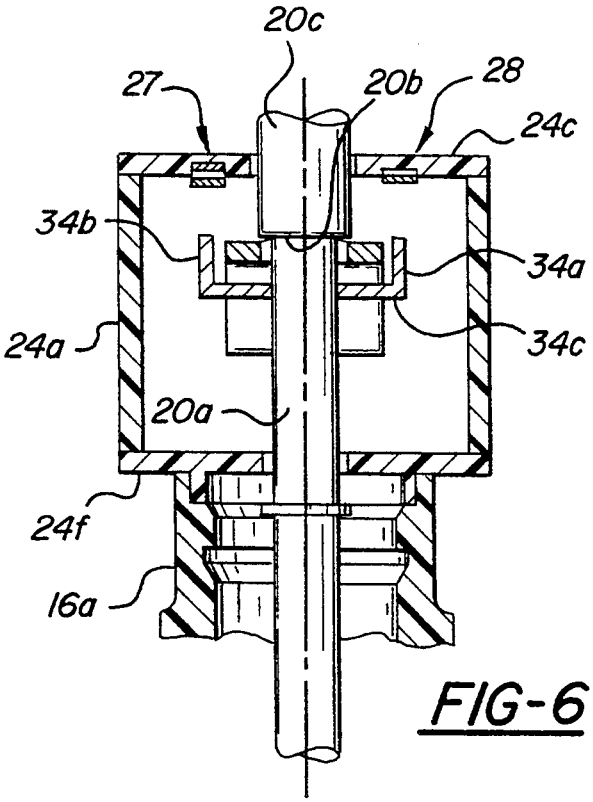
Figure 7:
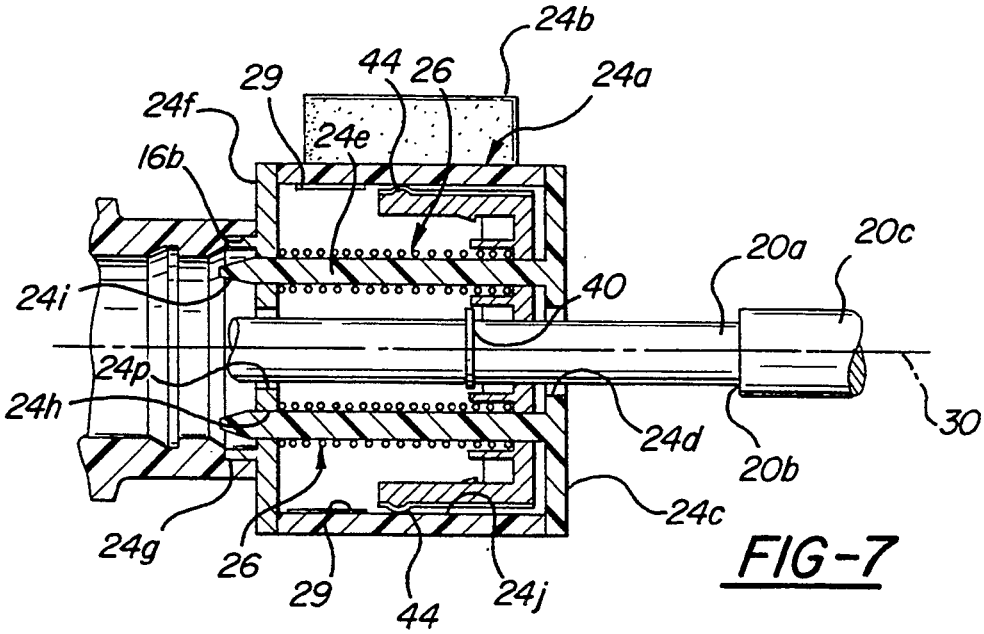
Figure 14:
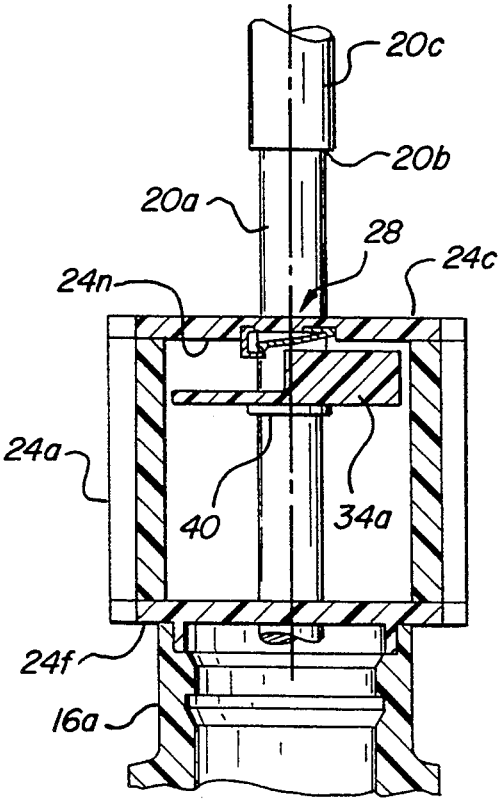
Figure 15:
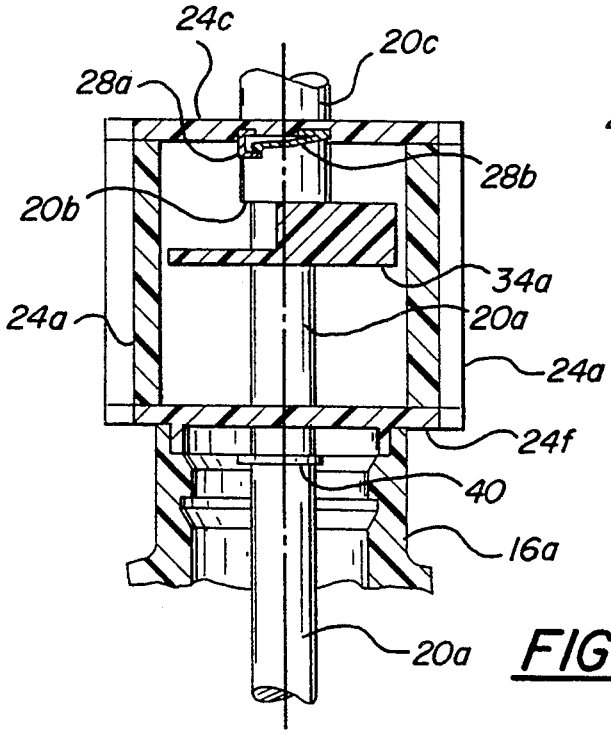
Figure 16:
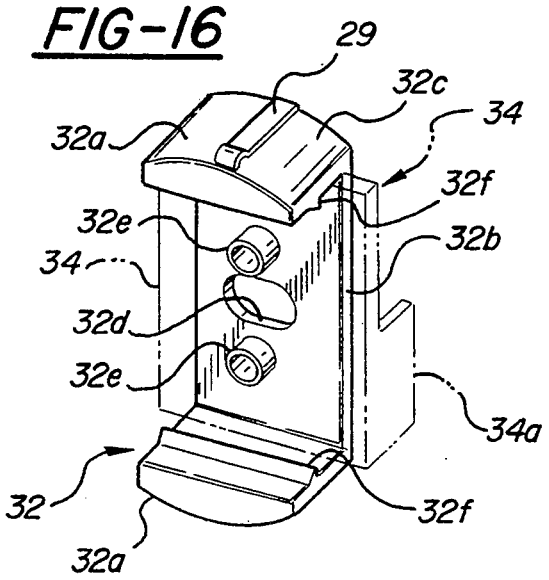
FIGS. 16 and 17 are detailed views of a plunger assembly utilized in the invention switch.
Figure 17:
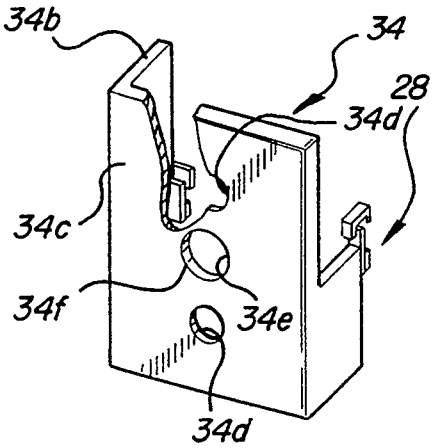

When the control pedal 12 is depressed to actuate the associated motor vehicle control system, the first increment of forward movement of the push rod 20 has the effect of moving ring 40 incrementally forwardly to allow secondary plunger member 34 to move forwardly under the urging of the spring bias of the switches 27 and 28 so that the cruise control switch 27 is moved to an open position (as seen in FIG. 5) and the EFI contact switch is moved to a closed position (as seen in FIG. 14). The first increment of forward movement of the secondary plunger member 34 under the urging of the switches 27 and 28 comprises forward movement of plunger member 34 relative to plunger member 32 (which is held against forward movement by springs 26) and results in the front face of the secondary plunger member moving into contact with the ridges 32*f* on the arms 32*a* of the primary plunger member. As the push rod continues its forward movement, the plunger assembly 32,34 is maintained in its position proximate the rear wall of the housing by the springs 26 and the push rod moves forwardly relative to the plunger assembly until the shoulder 20*b* on the push rod encounters the rearwardly facing surface 32*g* on the web portion of the primary plunger member, whereafter continued incremental forward movement of the push rod moves the plunger assembly 32,34 forwardly within the housing to bring electrical contacts 44 on the arm portions 32*a* of the primary plunger member 32 into respective engagement with the contact strips 29 positioned on the cylindrical inner surface of the housing whereby to complete any interlock circuit to allow the starter motor of the motor vehicle to be energized. Contact between contacts 44 and 29 continues as the push rod continues its forward movement to complete the total disengagement of the associated motor vehicle control system such, for example, as the clutch so that the interlock circuit is completed and remains completed during the entirety of the last portion of the forward movement of the push rod.

Figure 8:
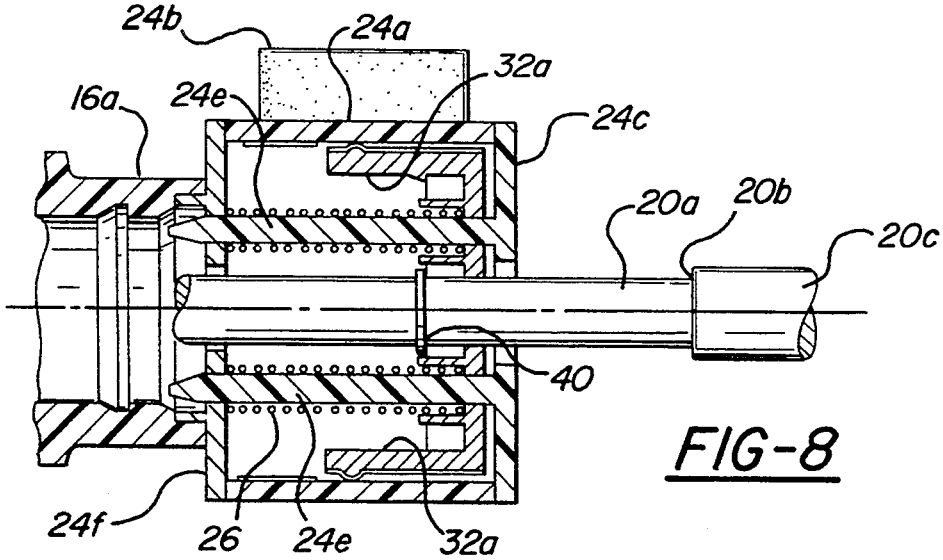
Figure 9:
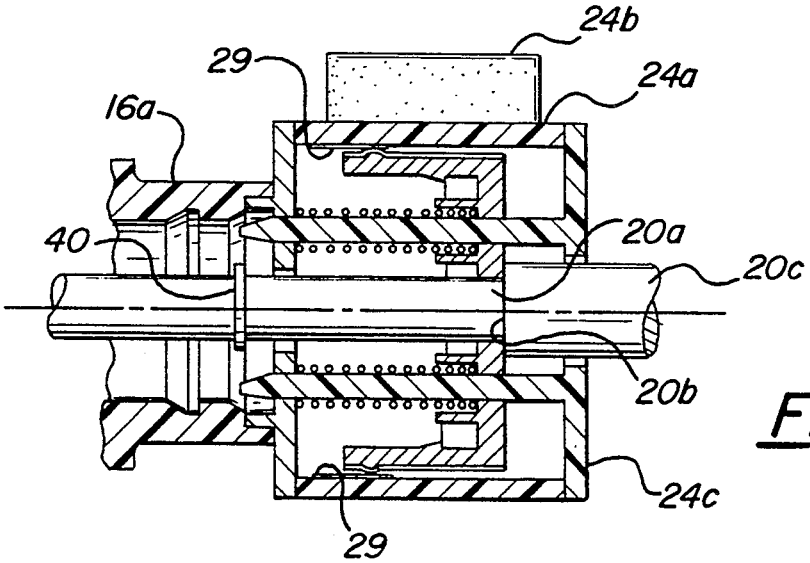

When the control pedal 12 is released by the operator, spring 42 acts to move the push rod rearwardly to its fully rearwardly extended position. Specifically, during the first increment of rearward movement of the returning push rod, the plunger assembly moves rearwardly with the push rod under the urging of springs 26 until the plunger assembly reaches the position seen in FIG. 8, whereupon the push rod continues rearwardly relative to the plunger assembly, separating the push rod shoulder 20*b* from the surface 32*g*, until the ring 40 engages the surface 34*f* on the secondary plunger member, whereafter during the final increment of rearward movement of the push rod the secondary plunger member is moved rearwardly by an amount sufficient to overcome the spring bias of the switches 27 and 28 and move the cruise control switch into a closed position and the EFI switch into an open position, both against the spring bias of the respective switch. Ring 40 continues to maintain the switches in the respective Closed and open positions until such time as the control pedal 12 is again depressed to begin a new cycle of operation.

It will be understood that contacts 50 provided in the contact housing portion 24*b* are suitably connected electrically to the various switches and switch contacts 27, 28, 29, and 44 so that a single harness (not shown) may be plugged into the housing portion 24*b* to connect electrically with the cruise control, EFI, and interlock switches and generate appropriate control signals for transmission to the appropriate vehicle control systems upon actuation of the cruise control, EFI, and interlock switches upon forward stroking movement of the push rod.

Although the master cylinder switch seen in FIGS. 1–17 has a total circular configuration so that it must be inserted axially over the push rod, there are many applications where it is preferable to mount the switch onto the push rod by a lateral movement of the switch relative to the push rod. A side mounting arrangement of this type is shown in FIGS. 18 and 19.

Figure 18:
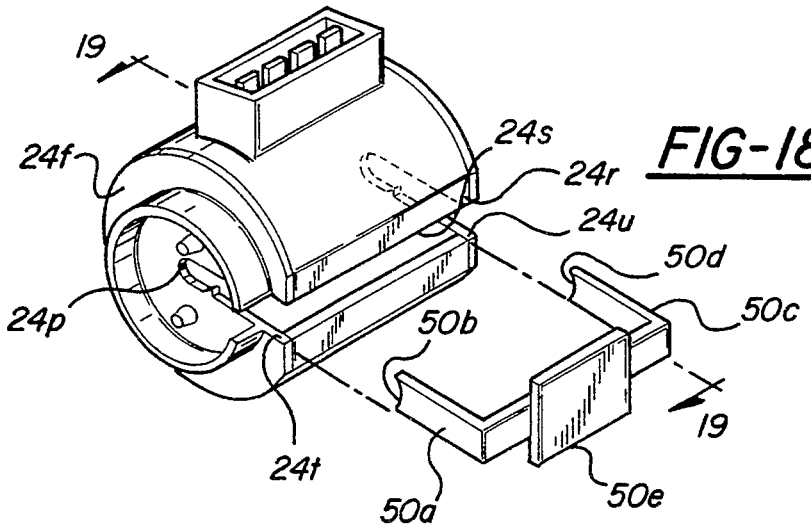
FIG. 18 is an exploded perspective view of a modified form of master cylinder switch according to the invention.
Figure 19:
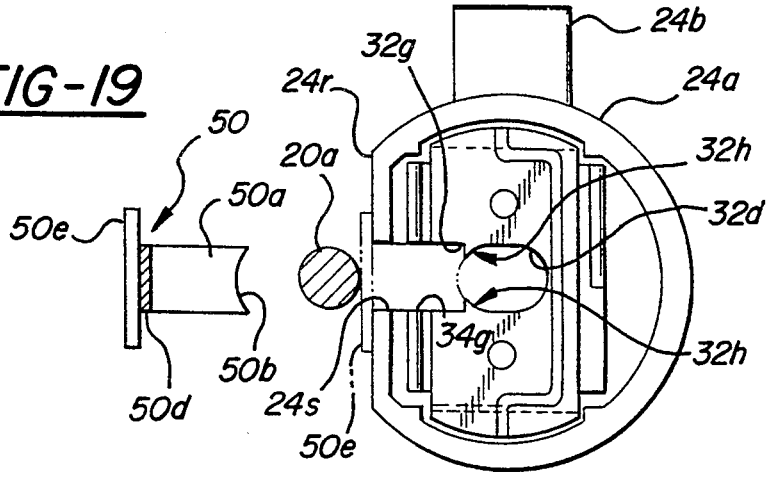
FIG. 19 is a cross-sectional view taken on line 19—19 of FIG. 18.

The master cylinder switch of FIGS. 18 and 19 is identical to the switch of FIGS. 1–17 in all respects except that a slot is provided in the assembly to allow the assembly to be mounted with a lateral movement onto the push rod. Specifically, the main body annular portion 24*a* of the housing includes a flat side wall portion 24r defining a longitudinal slot 24s; the front end wall member defines a laterally extending slot 24t opening in aperture 24p; the rear end wall member 24c defines a laterally extending slot 24u opening in central aperture 24d; primary plunger 32 defines a laterally extending slot 32g opening in central aperture 32d; and the secondary plunger 34 defines a laterally extending slot 34g opening in central aperture 34e. It will be seen that slots 24s, 24t, 24u, 32g, and 34g coact to allow the switch to be mounted onto push rod 20 with a lateral movement of the switch relative to the push rod so as to position the push rod within apertures 34e, 32d, 24d and 24p, whereafter a cover 50 may be installed to preclude inadvertent displacement of the switch from the push rod. The slots 24t, 24u, 32g and 34g preferably define necked down throat areas (for example throat area 32h) at their juncture with the respective central aperture so that the switch moves into position over the push rod with a snap action.

Cover 50 may for example include a front leg portion 50a sized to fit in slot 24t and terminating in an inboard arcuate surface 50b for coaction with aperture 24p; a rear leg portion 50c sized to fit in slot 24u and terminating in an inboard arcuate surface 50d for coaction with aperture 24d; a main body portion 50d sized to be received in slot 24s; and a mounting flange portion 50e adapted-to be positioned against the flat side surface 24r of the housing and including means (not shown) to detachably secure the flange plate, and thereby the cover, to the housing. The operation of the switch embodiment of FIGS. 18 and 19 is identical to the operation of the switch embodiment of FIGS. 1–17.

It will be seen that the invention switch, by virtue of the lost motion between the push rod and the plunger assembly, allows a relatively short switch to be utilized in conjunction with the push rod without sacrificing the necessity of the push rod to move a predetermined distance between the actuation of the Various switches, thereby enabling the invention switch to be utilized on even very short push rods, that is, push rods that are too short to accommodate prior art switches of the type shown in the previously identified prior art patents.

Further, the invention switch may be made with a relatively small outside diameter, small enough to pass through the existing master cylinder mounting hole in the firewall of the vehicle, so that the master cylinder, push rod, and switch may be installed as an assembly by passing the assembly through the firewall opening from the engine side of the firewall.

Whereas preferred embodiments of the invention has been illustrated and described in detail, it will be apparent that various changes may be made in the disclosed embodiment without departing from the scope or spirit of the invention.

I claim:

1. A hydraulic master cylinder assembly including a master cylinder, a piston mounted in the master cylinder, a push rod projecting at its forward end into the rear end of the master cylinder for connection to the piston, and a switch assembly positioned on the push rod and including a hollow switch housing defining axially spaced first and second switch means and a plunger assembly mounted for sliding movement in the housing in response to forward movement of the push rod to sequentially coact with the first and second switch means to actuate the first and second switch means to generate sequential first and second control signals, characterized in that:

in the initial increment of forward movement of the push rod the plunger assembly acts to actuate the first switch means;

in the second increment of forward movement of the push rod the push rod moves forwardly relative to the plunger assembly; and in the third increment of forward movement of the push rod the plunger assembly moves forwardly with the push rod to actuate the second switch means.

2. A master cylinder assembly according to claim 1 wherein:

the plunger assembly includes a first plunger member and a second plunger member mounted on the first plunger member and axially movable relative to the first plunger member; and the actuation of the first switch means upon the initial increment of forward movement of the push rod comprises movement of the second plunger member with the push rod and relative to the first plunger member.

3. A master cylinder assembly according to claim 2 wherein:

the first switch means is spring biased to a first position and movable against the resistance of the spring bias to a second position;

with the push rod in its fully rearwardly extended position the second plunger member maintains the first switch means in its second position; and as the push rod undergoes its initial increment of forward movement it releases the second plunger member and allows it to move forwardly with the push rod to allow the first switch means to move to its first position under the spring bias of the switch.

4. A master cylinder assembly according to claim 3 wherein:

the push rod defines first and second axially spaced radially extending actuating surfaces;

with the push rod in its fully rearwardly extended position the first actuating surface precludes forward movement of the second plunger member so as to maintain the first switch means in its second position; and the second actuating surface engages the plunger assembly as the push rod begins its third increment of forward movement.

5. A master cylinder assembly according to claim wherein:

the first actuating surface coacts with a forwardly facing surface on the second plunger member;

the second actuating surface coacts with a rearwardly facing surface on the first plunger member; and the actuating surfaces are spaced axially by a distance greater than the axial distance between the forwardly and rearwardly facing surfaces on the plunger assembly so that the push rod undergoes forward movement relative to the plunger assembly following the movement of the first switch means to its first position and prior to engagement of the plunger assembly by the second actuating surface.

6. A master cylinder assembly according to claim 5 wherein:

the first and second actuating surfaces comprise first and second annular shoulder surfaces on the push rod.

7. A master cylinder assembly according to claim 6 wherein:

one of said annular shoulders comprises a shoulder formed at the junction of a large diameter portion of the push rod with a reduced diameter portion of the push rod and the other annular shoulder is defined by a ring fixedly positioned on the reduced diameter push rod portion.

8. A hydraulic master cylinder assembly comprising:

a master cylinder;

a piston mounted within the master cylinder;

a push rod projecting at its front end into the rear end of the master cylinder for connection to the piston and movable forwardly from a fully rearwardly extended position;

a hollow switch housing mounted on the push rod with its front end proximate the rear end of the master cylinder;

first switch means on the housing proximate the rear end of the housing and including spring biasing means operative to bias the switch means to a first position, said switch means being movable against the resistance of the spring biasing means to a second position;

second switch means on the housing forwardly of the first switch means;

means operative with the push rod in its fully rearwardly extended position to maintain the first switch means in its second position against the resistance of the spring biasing means; and means operative in response to forward movement of the push rod to initially allow movement of the first switch means to its first position under the bias of the spring biasing means and to thereafter, with further forward movement of the push rod, actuate the second switch means.

9. A master cylinder assembly according to claim 8 wherein:

the operative means comprises a plunger assembly mounted on the push rod within the housing and first and second axially spaced radially extending actuating surfaces on the push rod coacting with forwardly and rearwardly facing surfaces on the plunger assembly.

10. A master cylinder assembly according to claim 9 wherein:

the first actuating surface engages the forwardly facing surface on the plunger assembly with the push rod in its fully rearwardly extended position to urge the plunger assembly into engagement with the first switch means to maintain the first switch means in-its first position;

the first actuating surface moves forwardly in response to the initial forward movement of the push rod from its fully rearwardly extended position to allow the first switch means to move to its first position under the bias of the spring biasing means; and the second actuating surface engages the rearwardly facing surface of the plunger assembly as the push rod moves further forwardly to move the plunger assembly forwardly to actuate the second switch means.

11. A master cylinder assembly according to claim 10 wherein:

the actuating surfaces are spaced axially by a distance greater than the distance between the forwardly and rearwardly facing surfaces on the plunger assembly so that the push rod undergoes forward movement relative to the plunger assembly following the movement of the first switch means to its first position and prior to engagement of the rearwardly facing surface of the plunger assembly by the second push rod actuating surface.

12. A push rod assembly for use with a master cylinder and including:

a push rod having a forward end for connection to the piston of the master cylinder;

a hollow stitch housing fitted over the push rod and including a rear end wall and an annular surface extending forwardly from the rear end wall in surrounding relation to the central axis of the push rod;

first switch means on the housing rear end wall spring biased to a first position and movable against the resistance of the spring to a second position;

second switch means on the annular surface axially spaced from and distinct from the first switch means; and a plunger assembly including a first plunger member mounted for axial movement int he housing for coaction with the second switch means and a second plunger member carried by, and movable axially relative to, the first plunger member for coaction with the first switch means.

13. A push rod assembly according to claim 12 wherein the push rod assembly further includes:

a first annular shoulder on the push rod operative with the push rod in its fully rearwardly extending position to engage a forwardly facing surface on the second plunger member and maintain the second plunger member in a position where it operates to maintain the first switch means in its second position; and a second annular shoulder on the push rod spaced axially from the first annular shoulder and operative in response to forward movement of the push rod to engage a rearwardly facing surface on the first plunger member and move the first plunger member axially forwardly within the switch housing for coaction with the second switch means.

14. A push rod assembly according to claim 13 wherein:

the first shoulder moves forwardly in response to the initial forward movement of the push rod from its fully rearwardly extending position to allow the second plunger member to move forwardly and in turn allow the first switch means to move to its first position under the spring bias of the switch; and the axial spacing between the annular shoulders on the push rod is greater than the axial spacing between the forwardly facing surface on the second plunger member and the rearwardly facing surface on the first plunger member so that, following the forward movement of the second plunger member to allow movement of the first switch means to its first position, the push rod moves forwardly relative to the plunger assembly prior to engagement of the second shoulder with the rearwardly facing surface on the first plunger member to move the first plunger member into coaction with the second switch means.

15. A push rod assembly according to claim 14 wherein:

one of the annular shoulder comprises a shoulder formed at the junction of a large diameter portion of the push rod with a reduced diameter portion of the push rod and the other annular shoulder is defined by a ring fixedly positioned on the reduced diameter push rod portion.

16. A push rod assembly including a push rod for connection to be connected to the piston of a master cylinder to move the piston axially forwardly in the cylinder in response to forward axial stroking movement of the push rod and a switch assembly positioned on the push rod rearwardly of the master cylinder and including a housing, a plunger mounted for axial movement in the housing, and first and second axially spaced switches coacting with the plunger in response to forward stroking movement of the push rod to generate first and second sequential control signals, characterized in that:

the plunger moves forwardly in response to the initial forward movement of the push rod to actuate the first switch;

the push rod thereafter moves forwardly relative to the plunger; and the plunger thereafter moves further forwardly in response to further forward movement of the push rod to actuate the second switch means.

17. A push rod assembly according to claim 16 wherein:

the plunger comprises a plunger assembly including a first plunger member and a second plunger member carried by and movable axially relative to the first plunger member;

the forward movement of the plunger in response to the initial forward movement of the push rod comprises forward movement of the second plunger member relative to the first plunger member; and the forward movement of the plunger in response to the further forward movement of the push rod comprises joint forward movement of the first and second plunger members.

18. A switch assembly comprising:

a hollow housing defining an axially extending chamber;

first switch means positioned forwardly on the housing in communication with said chamber;

second switch means positioned on the housing in communication with said chamber and axially spaced rearwardly from the first switch means;

a plunger assembly mounted in the housing for axial movement in the chamber and including a first plunger member movable within the chamber in response to axial movement of the piston assembly within the chamber along a path intersecting the second switch means so as to be operative to actuate the second switch means in response to axial movement of the plunger assembly in the housing and a second plunger member carried by but movable axially relative to the first plunger member and movable within the chamber in response to axial movement of the plunger assembly within the chamber between a rearward position proximate the first switch means and a forward position removed from the first switch means so as to be operative to actuate the first switch means in response to axial movement of the plunger assembly in the housing.

19. A switch assembly according to claim 18 wherein:

the first switch means has a first spring biased position and is movable to a second position against the bias of the spring;

the second plunger member urges the first switch means to its second position against the spring bias of the switch and is movable axially relative to the first plunger member under the spring bias of the switch.

20. A switch assembly according to claim 19 wherein:

the housing defines a rear end wall;

the first switch means is mounted on the rear end wall;

the second plunger member moves the first switch means to its second position against the bias of the spring as the second plunger member reaches the rear end of its axial movement.

* * * * *

UNITED STATES PATENT AND TRADEMARK OFFICE

CERTIFICATE OF CORRECTION

PATENT NO. : 5,343,005

DATED : August 30, 1994

INVENTOR(S) : David F. Salzmann

It is certified that error appears in the above-identified patent and that said Letters Patent is hereby corrected as shown below:

Column 1, Line 26, please delete "cut ore the" and insert --cut off the--.

Column 2, Line 1, please delete "Sequentially" and insert --sequentially--.

Column 5, Line 23, please delete "their .forward" and insert -- their forward--.

Column 5, Line 48, please delete "blade , contact" and insert --blade contact--.

Column 6, Line 15, please delete "any interlock" and insert --an interlock--.

Column6, Line 42, please delete "Closed" and insert --closed--.

Column 7, Line 27, please delete "adapted-to" and insert --adapted to--.

Column 7, Line 38, please delete "Various" and insert --various--.

UNITED STATES PATENT AND TRADEMARK OFFICE

CERTIFICATE OF CORRECTION

PATENT NO. : 5,343,005

DATED : August 30, 1994

INVENTOR(S) : David F. Salzmann

It is certified that error appears in the above-indentified patent and that said Letters Patent is hereby corrected as shown below:

Column 8, Line 49, please delete "claim wherein" and insert --claim 4 wherein--.

Column 9, Line 52, please delete "in-its" and insert --in its--.

Column 10, Line 11, please delete "stitch" and insert --switch--.

Column 10, Line 23, please delete "int he" and insert --in the--.

Column 11, Line 6, please delete "to be connected".

Signed and Sealed this

Tenth Day of January, 1995

*Attest:*

Bruce Lehman

BRUCE LEHMAN

*Attesting Officer*

*Commissioner of Patents and Trademarks*